US005749181A

United States Patent [19]

Bauman

[11] Patent Number: 5,749,181

[45] Date of Patent: May 12, 1998

[54] UNDERGROUND EMERGENCY SHELTER SYSTEM

[76] Inventor: Michael James Bauman, P.O. Box 328, Silverhill, Ala. 36576

[21] Appl. No.: 633,666

[22] Filed: Apr. 17, 1996

[51] Int. Cl.[6] ..... E04H 9/12

[52] U.S. Cl. ..... 52/169.6; 52/23; 52/302.1

[58] Field of Search ..... 52/169.6, 169.7, 52/169.9, 23, 302.1; 109/1 R, 1 S; 220/4.12, 565

[56] References Cited

U.S. PATENT DOCUMENTS

| | | | |
|---|---|---|---|
| 2,955,549 | 10/1960 | Frankfort | 109/1 S |
| 2,968,130 | 1/1961 | Bascom | 109/1 S X |
| 3,118,401 | 1/1964 | Platt | 109/1 S |
| 3,159,117 | 12/1964 | Rosenfeld | 52/169.6 X |
| 3,212,220 | 10/1965 | Boniecki et al. | 52/169.6 X |
| 3,845,597 | 11/1974 | Foster | 52/23 X |
| 3,846,943 | 11/1974 | Wagner | 52/23 |
| 3,903,704 | 9/1975 | Spiridonov | 52/23 X |
| 4,534,144 | 8/1985 | Gustafsson et al. | 52/169.6 |
| 4,539,780 | 9/1985 | Rice | 52/169.6 |
| 4,631,872 | 12/1986 | Daroga | 109/1 S X |
| 4,805,360 | 2/1989 | Kuehnl | 52/169.6 X |
| 4,955,166 | 9/1990 | Qualline et al. | 52/169.6 |
| 5,115,613 | 5/1992 | McCarthy | 52/169.6 |
| 5,167,142 | 12/1992 | Sharp | 220/4.12 X |
| 5,381,923 | 1/1995 | O'Dea | 220/4.12 X |
| 5,582,310 | 12/1996 | Del Zotto | 220/4.12 |

FOREIGN PATENT DOCUMENTS

| | | | |
|---|---|---|---|
| 410584 | 4/1945 | Italy | 109/1 S |
| 2075570 | 11/1981 | United Kingdom | 52/169.6 |

*Primary Examiner*—Michael Safavi
*Attorney, Agent, or Firm*—Joseph N. Breaux

[57] ABSTRACT

An underground emergency shelter system for sanctuary during emergency weather conditions. A tubular entrance-way allows access to the underground structure. Air intake vent stacks are positioned along with air output vent stacks to provide on top of the shell member which forms the shelter. Battery powered blowers serve to circulate air flow into and out of the shelter. Spaced stabilizing feet are provided underneath the shell member with T-shaped anchors lying on either side of the shell member to hold the shelter in place beneath the ground. Steel cable members are fitted within channels formed circumferentially around the upper portion of the shell member and are each attached to a pair of anchors thus serving to hold the shell in place. A waste holding tank is provided within the shell member along with a potable water holding tank.

18 Claims, 2 Drawing Sheets

UNDERGROUND EMERGENCY SHELTER SYSTEM

TECHNICAL FIELD

The present invention relates to emergency shelters and more particularly to a prefabricated underground weather emergency shelter that is installed within a trench, anchored by a series of stainless steel bands that are each secured to a pair of concrete covered butterfly anchors and then covered with earth.

BACKGROUND ART

It is often necessary during a weather emergency to seek shelter because of high winds. Surface structures are particularly susceptible to damage from high winds and wind blown debris. It would be a benefit, therefore, to have an emergency shelter located below the earth surface that could be retreated to when weather emergencies arise.

Although underground shelters afford excellent protection during weather emergencies, they can be difficult and expensive to construct. It would be a benefit, therefore, to have a prefabricated weather emergency shelter system that could be delivered to the site, installed within a trench, anchored in place and then covered with a layer of soil, leaving only air connections and an entranceway above the soil surface.

GENERAL SUMMARY DISCUSSION OF INVENTION

It is thus an object of the invention to provide an underground emergency shelter system.

It is a further object of the invention to provide an underground emergency shelter system that is prefabricated and installed within a trench on site.

It is a still further object of the invention to provide an underground emergency shelter system that is lightweight and that is anchored beneath the soil surface with a plurality of anchor assemblies.

It is a still further object of the invention to provide an underground emergency shelter system that accomplishes all or some of the above objects in combination.

Accordingly, an underground emergency shelter system is provided. The emergency shelter system comprises a shell member having a tubular central section and first and second hemispherical end sections that define a sanctuary compartment within the shell member, a waste holding tank integrally formed within the sanctuary compartment, a potable water holding tank integrally formed within the sanctuary compartment, and a dry storage compartment having a hinged access door; a tubular entranceway in connection with the sanctuary compartment through an outer wall of the central section that extends outward from the central section a distance of at least fifteen inches; an air intake vent stack, in airflow connection with the sanctuary compartment, having a 180 degree arc formed in a first distal end thereof, extends radially outward from the central section a distance of about fifteen inches at a farthest point; an air output vent stack, in airflow connection with the sanctuary compartment, having a 180 degree arc formed in a second distal end thereof, extends radially outward from the central section a distance of about fifteen inches at a farthest point; at least three anchor band channels extending from an outer surface of the central section extending at least 180 degrees around the circumference thereof along a section of the central section that includes the air intake and air output vent stacks; four spaced stabilizing feet assemblies extending tangentially from the outer surface of the central section; six anchor assemblies, each anchor assembly including a T-shaped butterfly anchor having a central member having a cable attaching aperture formed therein at a distal end thereof; three flexible, stainless steel cable members having attachment fittings at either end thereof adapted for securement to one of the attachment apertures of the eight T-shaped butterfly anchors; a chemical toilet facility in operable connection with the waste holding tank; an air intake system having an electric intake blower in airflow connection with the air intake vent stack; and an air output system having an electric air output blower in airflow connection with the air output vent stack.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
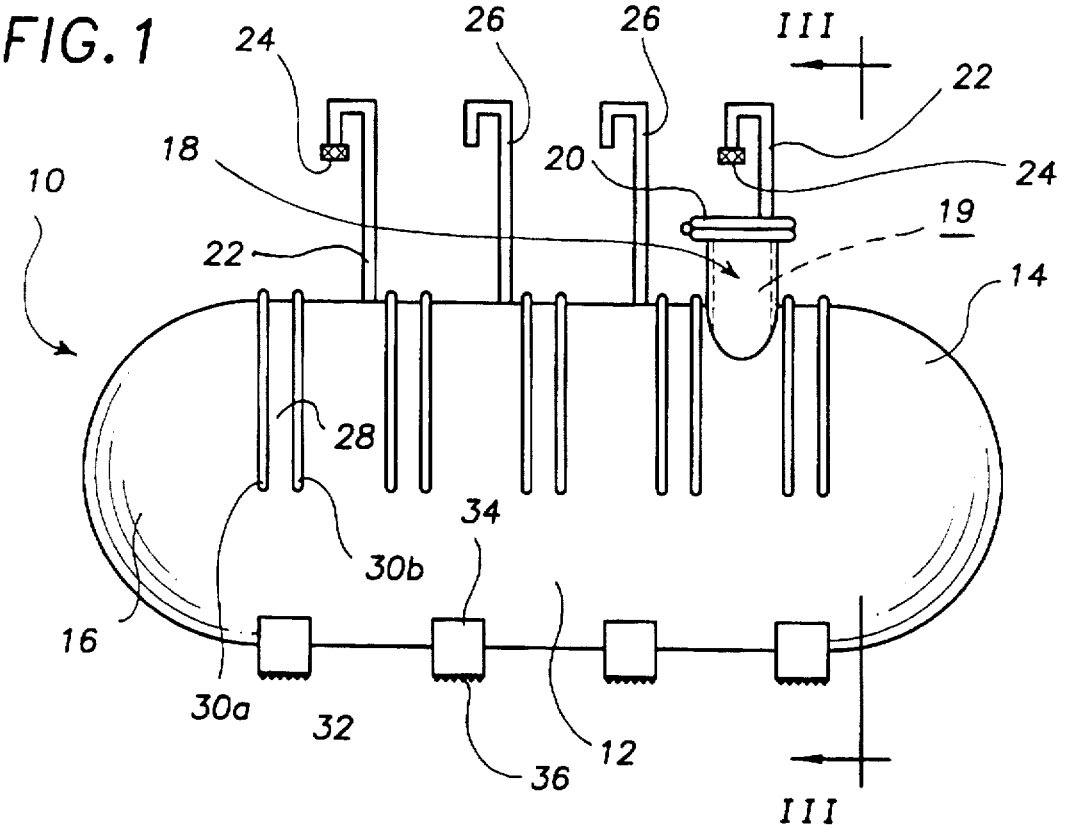
FIG. 1 is a side view of an exemplary shell member of the shelter system of the present invention showing an exemplary tubular central section and first and second hemispherical end sections; a tubular entranceway; two air intake vent stacks; two air output vent stacks; five anchor band channels; and four spaced stabilizing feet assemblies.

FIG. 1 shows an exemplary shell member of the shelter system of the present invention, generally designated by the numeral 10. Shell member 10 is constructed from molded fiberglass and includes a tubular central section 12 and first and second hemispherical end sections 14, 16. Shell member 10 measures about thirty (30') feet in length and about six and one-half (6½') feet in diameter. A tubular entranceway 18 constructed from fiberglass is formed along a top section of central section 12 and extends outwardly from central section 12 a distance of about twelve inches. Entranceway 18 has a tubular passageway 19 measuring about three (3") feet in diameter. Entranceway 18 also includes a hinged lid member 20 that is securable in a closed position sealing tubular passageway 19.

Two cane shaped, air intake vent stacks 22 are located on either end of central section 12 and extend outwardly therefrom a distance of about fifteen (15") inches at their farthest point. The distal end of each air intake vent stack 22 is curved into a cane shape and a brass mesh filter 24 is provided at the intake end to screen out flying debris. Two cane shaped air output vent stacks 26 are also provided on central section 12 between the two air intake vent stacks 22. Air output vent stacks 26 extend outwardly from central section 12 a distance of about fifteen (15") inches and are positioned between air intake vent stacks 22 to allow fresh air to enter at least one of the air intake vent stacks 22 regardless of the wind direction.

Five anchor band channels 28, each formed by a pair of channel ridges **30*a*,30*b* are integrally formed with central section 12, are provided on the exterior of central section 12. Each anchor band channel 28 extends about 200 degrees around the circumference of central section 12 along a section of central section 12 that includes the air intake and air output vent stacks 22,26**.

Four spaced, five and one-half (5½') feet long, fiberglass, stabilizing feet assemblies 32 extend tangentially from the bottom outer surface of central section 12. Each stabilizing assembly 32 includes a foot member 34 having five parallel oriented gripping ridges 36 that extend the length of each foot member 34 positioned on a bottom surface of each foot member 34.

Figure 2:
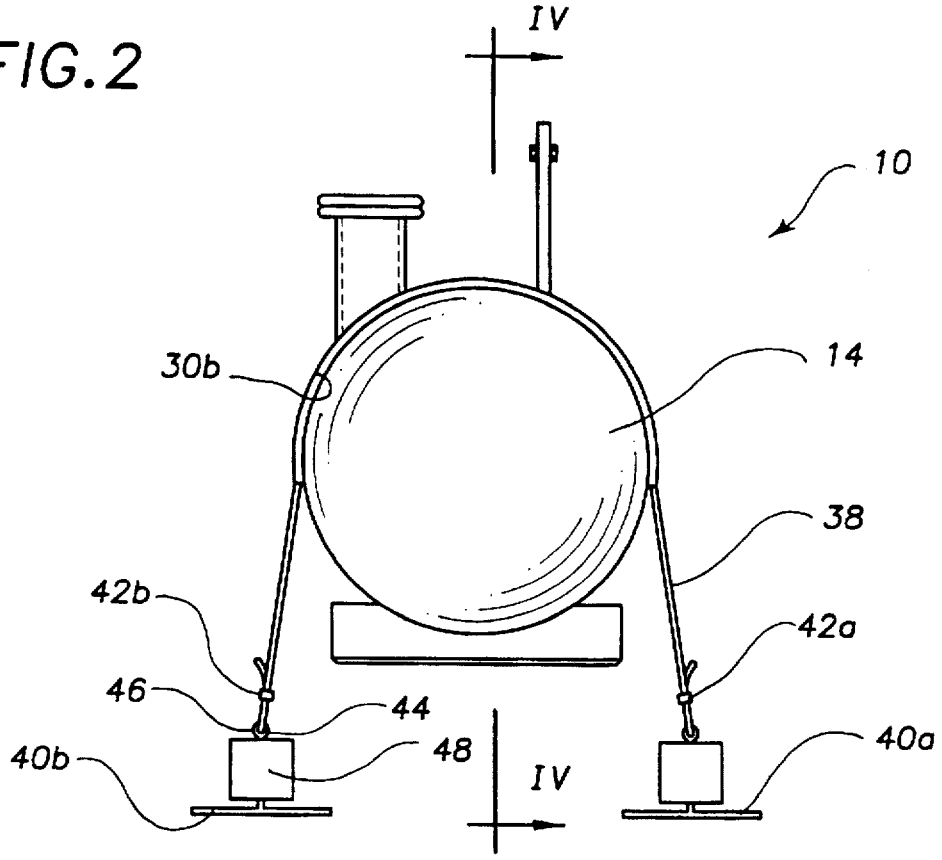
FIG. 2 is a end view from the first hemispherical end section showing two of the eight anchor assemblies each anchor assembly including a T-shaped butterfly anchor having a central member having a cable attaching aperture formed therein at a distal end thereof and one of the five flexible, stainless steel cable members with the attachment fittings at either end thereof secured to one of the attachment apertures of the T-shaped butterfly anchors.

FIG. 2 is an end view of shell member 10 from first hemispherical end section 14 showing a channel ridge **30*b* partially obscuring one of five flexible, stainless steel cable members 38 that are each used in combination with a pair of T-shaped butterfly anchors 40*a*,40*b* to stabilize and anchor shell member 10 in place during installation of shell member 10 beneath the earth surface. Each cable member 38 has attachment fittings 42*a*,42*b* at either end thereof that are adapted for securement to an attachment aperture 44 formed along a central spar 46 of each of the eight T-shaped butterfly anchors 40*a*,40*b*. Each central spar 46 is partially encased within a concrete block 48** to provide greater anchoring.

Figure 3:
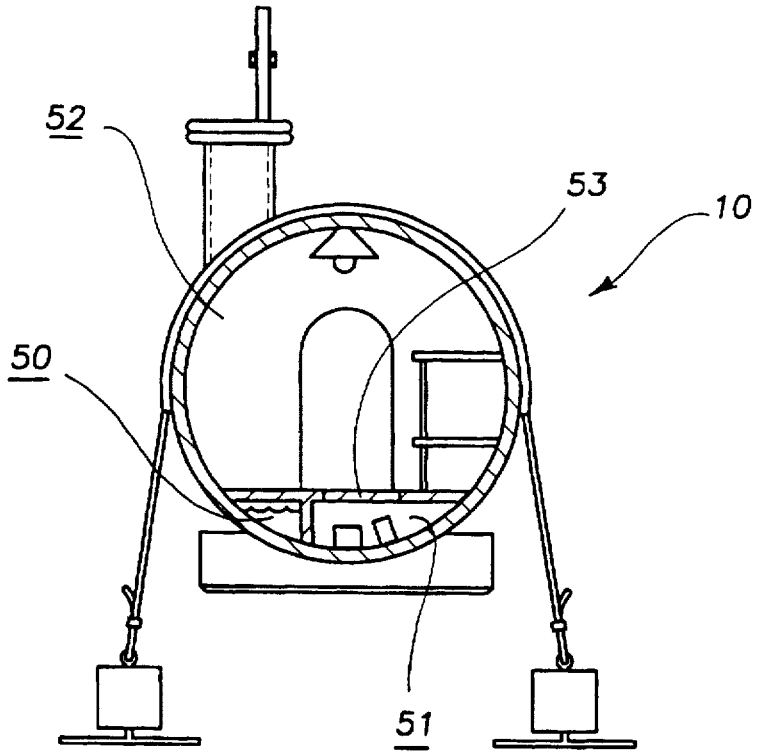
FIG. 3 is a cross-sectional view of the shell member along the line III—III of FIG. 1 showing an exemplary potable water holding tank, integrally formed within the sanctuary compartment, and a dry storage compartment having a hinged access door.
Figure 4:
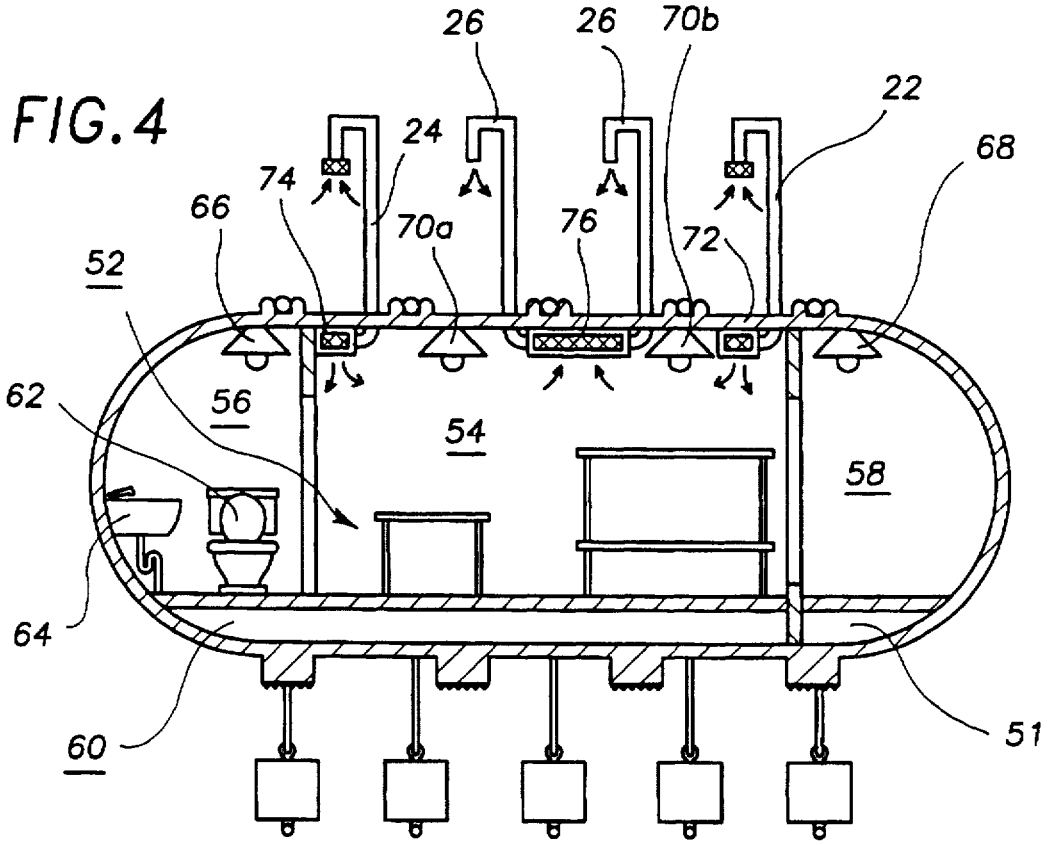
FIG. 4 is a cross-sectional view of the shell member along the line IV—IV of FIG. 2 showing an exemplary a waste holding tank, the potable water holding tank, a chemical toilet facility, an air intake system having an electric intake blower, and an air output system having an electric air output blower.

With reference to FIG. 3, a crossectional view of shell member 10 along the line III—III of FIG. 1, a potable water holding tank 50 and a dry storage compartment 51 having a hinged access door 53 is integrally formed beneath a sanctuary compartment 52. With reference to FIG. 4, sanctuary compartment 52 is divided into a centrally disposed housing area 54, a toilet area 56 and a storage area 58. A liquid waste storage chamber 60 is provided beneath housing area 54 and toilet area 56 for receiving waste discharges from a chemical toilet 62 and a sink 64. In this embodiment, toilet area 56 and storage area 58 are each provided with a battery powered lamp 66, 68, respectively, and housing area 54 is provided with a pair of battery powered lamps **70*a*,70*b*. Each air intake vent stack 22, is in airflow connection, respectively, with an independently controllable battery powered intake blower 72,74. The term "airflow connection" is used herein to mean that an air flow pathway is established between the vent stack and the blower in a manner to allow the blower to cause air to travel through the vent stack. Use of multiple intake blowers 72,74 in connection with multiple air intake vent stacks provides redundancy to the air intake system in case one of the intake blowers fails or one of the air intake vent stacks becomes clogged with wind blown debris. A single battery powered air output blower 76 is in airflow connection with both air output vent stacks 26**.

Installation of the shelter system is now described with general reference to FIGS. 1–4. Installation of the shelter system is accomplished by digging a first trench approximately seven (7') feet deep, ten (10') feet wide, and thirty (30') feet long into the earth at the desired installation site. A pair of thirty (30') feet long, one and one-half (1½') feet wide, two (2') feet deep anchor trenches, spaced about six and one-half (6½') feet apart, are then formed in the bottom of the first trench. Five T-shaped butterfly anchors 40, each including a central spar 46 partially encased within a concrete block 48, are then placed within each anchor trench with the central spars 46 directed upward. Soil is then replaced within each of the anchor trenches until only the attachment aperture 44 of each central spar 46 remains above the soil surface.

With the ten T-shaped butterfly anchors 40 in place, shell member 10 is lowered into the first trench until the gripping ridges 36 of each foot member 34 is positioned onto the bottom of the first trench and the tubular entranceway 18, two cane shaped, air intake vent stacks 22, and two cane shaped air output vent stacks 26 are positioned above the edge of the first trench. Five flexible, stainless steel cable members 38 are then each placed within an anchor band channel 28 and the ends thereof secured to an attachment aperture 44 of one of the central spars 46 with an attachment fitting 42 and the length adjusted until shell member 10 is held securely on place by cable members 38. Soil is then added to the first trench until shell member 10 is covered with earth. The shelter is used by simply opening hinged lid member 20, entering sanctuary chamber 52, sealing lid member 20 behind and activating the battery powered lamps **66,68,70*a*,70*b* the intake blowers 72,74 and the air output blower 76. The user can then remain within the sanctuary compartment 52** until the weather emergency has subsided.

It can be seen from the preceding description that an underground emergency shelter system has been provided that is prefabricated off-site, that is installed within a trench on-site, that is lightweight, and that is anchored beneath the soil surface with a plurality of anchor assemblies.

It is noted that the embodiment of the underground emergency shelter system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An underground emergency shelter system comprising:

a shell member having a tubular central section and first and second hemispherical end sections that define a sanctuary compartment within said shell member, a waste holding tank integrally formed within said sanctuary compartment, a potable water holding tank integrally formed within said sanctuary compartment, and a dry storage compartment having a hinged access door;

a tubular entranceway in connection with said sanctuary compartment through an outer wall of said tubular central section that extends outward from said tubular central section a distance of at least fifteen inches;

a first air intake vent stack, in airflow connection with said sanctuary compartment, having a 180 degree arc formed in a first distal end thereof, extending radially outward from said tubular central section a distance of about fifteen inches at a farthest point;

a first air output vent stack, in airflow connection with said sanctuary compartment, having a 180 degree arc formed in a second distal end thereof, extending radially outward from said tubular central section a distance of about fifteen inches at a farthest point;

a second air intake vent stack; said first and second air intake vent stacks being each located on an end of said tubular central section, said first air output vent stack being positioned between said first and second air intake vent stacks;

at least three anchor band channels extending from an outer surface of said tubular central section extending at least 180 degrees around said circumference thereof along a section of said tubular central section that includes said first air intake and first air output vent stacks;

four spaced stabilizing feet assemblies extending tangentially from said outer surface of said tubular central section;

six anchor assemblies, each anchor assembly including a T-shaped butterfly anchor having a central member having a cable attaching aperture formed therein at a distal end thereof;

three flexible, stainless steel cable members having attachment fittings at either end thereof adapted for securement to one of said attachment apertures of said six T-shaped butterfly anchors;

a chemical toilet facility in operable connection with said waste holding tank;

an air intake system having a first electric air intake blower in airflow connection with said first air intake vent stack; and an air output system having an electric air output blower in airflow connection with said first air output vent stack.

2. The underground emergency shelter system of claim 1, wherein:

said shell member is constructed from molded fiberglass; and said tubular central section and first and second hemispherical end sections are integrally formed.

3. The underground emergency shelter system of claim 1, wherein:

said tubular entranceway is constructed from fiberglass and includes a hinged lid member that is securable in a closed position sealing a tubular passageway formed through said tubular entranceway.

4. The underground emergency shelter system of claim 1 wherein:

said at least three anchor band channels are each formed by a pair of channel ridges integrally formed with and extending outwardly from said central section.

5. The underground emergency shelter system of claim 1 wherein:

each of said at least three anchor band channels extends about 200 degrees around the circumference of said central section.

6. The underground emergency shelter system of claim 1 wherein:

each of said four spaced stabilizing feet assemblies includes a foot member having a plurality of parallel oriented gripping ridges that extend the length of each said foot member and are positioned on a bottom surface of each said foot member.

7. The underground emergency shelter system of claim 1, wherein:

said air intake system further includes a second electric air intake blower in airflow connection with said second air intake vent stack; and said first and second electric air intake blowers are independently controllable.

8. The underground emergency shelter system of claim 4 wherein:

each of said at least three anchor band channels extends about 200 degrees around the circumference of said central section.

9. The underground emergency shelter system of claim 4 wherein:

each of said four spaced stabilizing feet assemblies includes a foot member having a plurality of parallel oriented gripping ridges that extend the length of each said foot member and are positioned on a bottom surface of each said foot member.

10. The underground emergency shelter system of claim 4, wherein:

said air intake system further includes a second electric air intake blower in airflow connection with said second air intake vent stack; and said first and second electric air intake blowers are independently controllable.

11. The underground emergency shelter system of claim 8 wherein:

each of said four spaced stabilizing feet assemblies includes a foot member having a plurality of parallel oriented gripping ridges that extend the length of each said foot member and are positioned on a bottom surface of each said foot member.

12. The underground emergency shelter system of claim 8, wherein:

said air intake system further includes a second electric air intake blower in airflow connection with said second air intake vent stack; and said first and second electric air intake blowers are independently controllable.

13. The underground emergency shelter system of claim 11, wherein:

said air intake system further includes a second electric air intake blower in airflow connection with said second air intake vent stack; and said first and second electric air intake blowers are independently controllable.

14. The underground emergency shelter system of claim 5 wherein:

each of said four spaced stabilizing feet assemblies includes a foot member having a plurality of parallel oriented gripping ridges that extend the length of each said foot member and are positioned on a bottom surface of each said foot member.

15. The underground emergency shelter system of claim 5, wherein:

said air intake system further includes a second electric air intake blower in airflow connection with said second air intake vent stack; and said first and second electric air intake blowers are independently controllable.

16. The underground emergency shelter system of claim 14, wherein:

said air intake system further includes a second electric air intake blower in airflow connection with said second air intake vent stack; and said first and second electric air intake blowers are independently controllable.

17. The underground emergency shelter system of claim 6, wherein:

said air intake system further includes a second electric air intake blower in airflow connection with said second air intake vent stack; and said first and second electric air intake blowers are independently controllable.

18. The underground emergency shelter system of claim 17, wherein:

said tubular entranceway is constructed from fiberglass and includes a hinged lid member that is securable in a closed position sealing a tubular passageway formed through said tubular entranceway.

* * * * *